United States Patent [19]

Thomas

[11] Patent Number: 4,998,587

[45] Date of Patent: Mar. 12, 1991

[54] FIRE EXTINGUISHER CABINET WITH SEALING MEANS

[76] Inventor: Loyd Thomas, 5825 Hall, Corpus Christi, Tex. 78409

[21] Appl. No.: 451,044

[22] Filed: Dec. 15, 1989

Related U.S. Application Data

[63] Continuation-in-part of Ser. No. 229,238, Aug. 8, 1988, abandoned.

[51] Int. Cl.[5] ..... A62C 33/00; A62C 39/00

[52] U.S. Cl. ..... 169/51; 312/296

[58] Field of Search ..... 169/51, 69; 312/296; 220/344

[56] References Cited

U.S. PATENT DOCUMENTS

| | | | |
|---|---|---|---|
| D. 251,464 | 4/1979 | Masters | 169/51 |
| 1,209,544 | 12/1916 | Bolger | 220/344 |
| 1,720,170 | 7/1929 | Davies | 312/296 |
| 2,036,569 | 4/1936 | Darbyshire | 312/296 |
| 2,550,493 | 4/1951 | Ohlson | 220/344 |
| 3,067,822 | 12/1962 | Hattenhauer | 169/51 |
| 3,175,873 | 3/1965 | Blomquist et al. | 312/296 |
| 4,449,588 | 5/1984 | Benlolo et al. | 169/51 |
| 4,763,732 | 8/1988 | Neal | 169/51 |

*Primary Examiner*—Sherman Basinger
*Assistant Examiner*—Stephen P. Avila
*Attorney, Agent, or Firm*—G. Turner Moller

[57] ABSTRACT

A fire extinguisher cabinet includes a generally rectangular compartment closed by a hinged door. The door includes a front panel having a depending skirt. A gasket straddles the edge of the compartment periphery and seals against the door when the door is closed. Toggle type latches secure the door in place and compress the gasket to seal against the front door panel and against the skirt.

5 Claims, 1 Drawing Sheet

FIG. 1
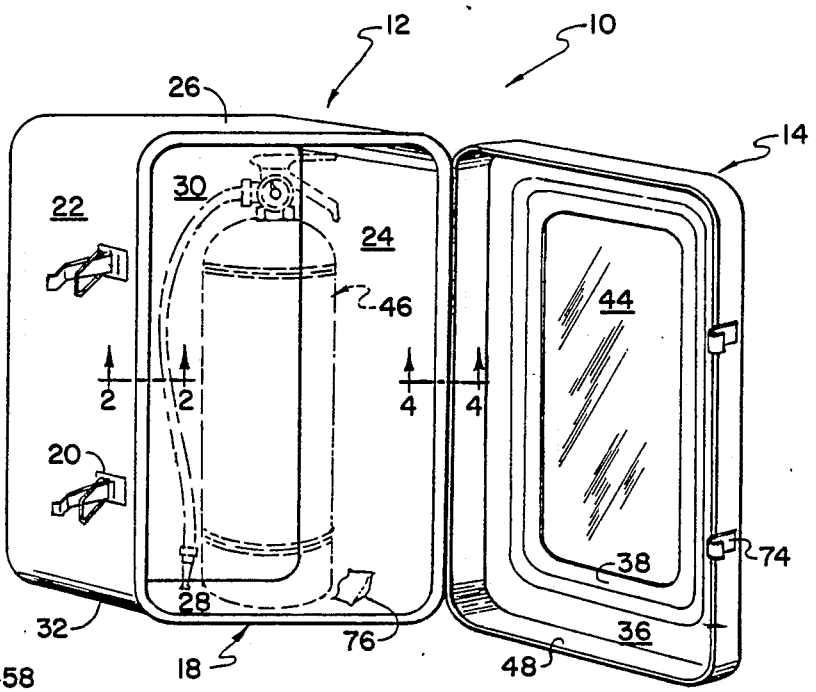
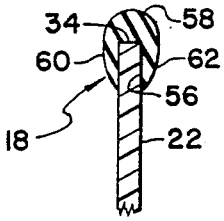
FIG. 2
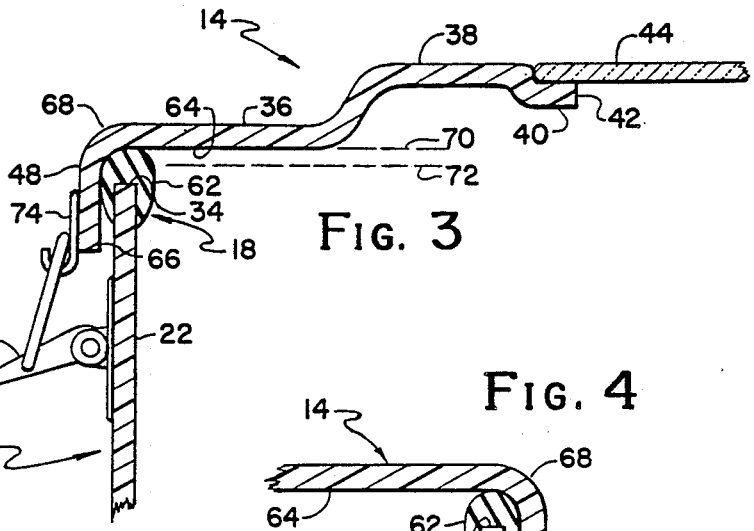
FIG. 3
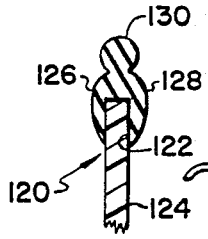
FIG. 6
FIG. 4
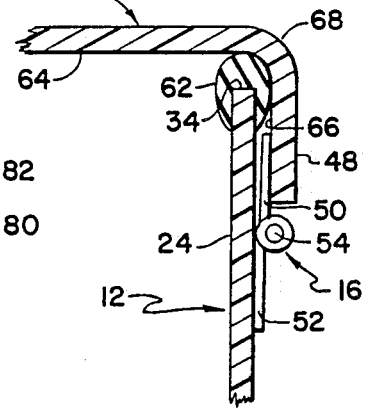
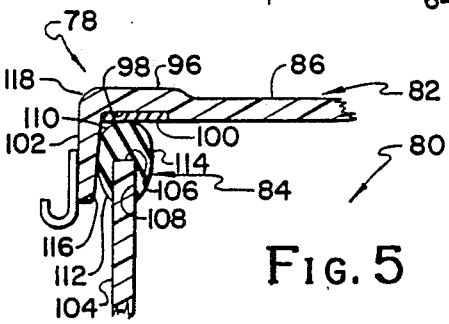
FIG. 5

FIRE EXTINGUISHER CABINET WITH SEALING MEANS

This application is a continuation of application Ser. No. 07/229,238, filed Aug. 8, 1988 now abandoned.

This invention relates to a fire extinguisher cabinet and more particularly to an air tight fire extinguisher cabinet.

Fire extinguishers are typically mounted in a rectilinear cabinet mounted on the wall of a building, as every child has seen in school. Such cabinets are usually locked to prevent casual access to the extinguisher and typically include a transparent front wall which is broken to gain access to the extinguisher. The idea is that the front wall, which is usually glass, will keep out the curious but not deter someone in an emergency. Disclosures of this general type are found in U.S. Pat. Nos. D 205,354; 3,722,733; 4,034,697; and 4,046,439.

Such cabinets are often mounted out doors, on the side of buildings, on off shore oil platforms, in refineries and the like. Typically, corrosion resistant fire extinguishers are employed in out door cabinets and perform suitably. No one has apparently heretofore appreciated that even corrosion resistant fire extinguishers are not adequately protected in conventional fire extinguisher cabinets even though such cabinets are designed to shed water. Disclosures of some interest relative to this invention are found in U.S. Pat. Nos. 1,720,170 and 1,773,693.

In summary, this invention comprises a fire extinguisher cabinet having an upright generally rectangular compartment including a front wall or door sealed against the compartment. The front door preferably is transparent or provides a transparent section so the presence and condition of the fire extinguisher can be visually monitored without breaking the seal between the door and compartment. The front door is preferably pivoted on one side of the compartment with latches on the other side to hold the door in a closed sealed position. The front door preferably comprises a front generally planar panel having a skirt extending away from the plane of the panel.

The seal between the door and compartment comprises a gasket having a groove on the underside thereof receiving a planar peripheral edge of the compartment. The gasket provides a curved sealing surface sealing against the front door panel in a path comprising an extension of the peripheral compartment edge. In addition, the gasket abuts and seals against the skirt of the panel in a plane generally parallel to the plane of the front door panel. A quantity of desiccant material is preferably placed in the compartment along with the fire extinguisher to adsorb some or all of the water vapor existing in the cabinet after the front door is closed and sealed.

It is accordingly an object of this invention to provide an improved fire extinguisher cabinet.

Another object of this invention is to provide an air tight fire extinguisher cabinet providing extended life of the fire extinguisher therein.

Other objects and advantages of this invention will become more fully apparent as this description proceeds, reference being made to the accompanying drawing and appended claims.

IN THE DRAWINGS

FIG. 1 is an isometric view of a fire extinguisher cabinet in accordance with this invention illustrated with the door in an open position;

FIG. 2 is an enlarged cross-sectional view of the device of FIG. 1 taken substantially along line 2—2 thereof as viewed in the direction indicated by the arrows;

FIG. 3 is a view similar to FIG. 2 illustrating the door in the closed and sealed position;

FIG. 4 is an enlarged cross-sectional view of the device of FIG. 1 taken along the hinged side of the door;

FIG. 5 is a view similar to FIG. 3 illustrating another embodiment of this invention in a closed and sealed position; and FIG. 6 is a view similar to FIG. 2 illustrating another embodiment of this invention.

Referring to FIGS. 1–4, a fire extinguisher cabinet 10 comprises, as major components, a compartment 12, a door or front panel 14, means 16 mounting the door for pivotal movement between the open position illustrated in FIG. 1 to a closed position shown in FIG. 3, a gasket 18 sealing between the compartment 12 and door 14 in the closed position thereof and one or more latches 20 securing the door 14 in its closed position.

The compartment 12 is preferably an elongate generally rectangular receptacle comprising a pair of parallel side walls 22, 24, a top wall 26, a bottom wall 28 and a back wall 30. The junctions between the side walls 22, 24, top wall 26 and bottom wall 28 comprise a series of curved corners 32 having a radius of at least 2" for purposes more fully apparent hereinafter. The side walls 22, 24, top wall 26 and bottom wall 28 provide a series of edges 34 which, taken together define a plane.

The door or front wall 14 provides an opaque front panel 36 having a raised central section 38 and a depressed lip 40 extending around a central opening 42. A transparent section 44 is adhesively secured or otherwise bonded to the lip 40 to allow visual inspection of a fire extinguisher 46 in the compartment 12. Extending around the front panel 36 and extending generally perpendicular thereto is a skirt 48 which, in the closed position of the door 14, overlaps the upper ends of the side walls 22, 24, top wall 26 and bottom wall 28 as is evident in FIGS. 3 and 4.

As shown in FIG. 4, the hinge 16 is preferably of the piano hinge type and includes a first planar section 50 secured to the skirt 48, a second planar section 52 secured to the side wall 24 and a hinge pin 54 securing the sections 50, 52 together for relative pivotal movement.

The gasket 18 comprises an elongate bodily flexible member of substantially the same length as the perimeter of the compartment 12 as measured along the edge 34. The gasket 18 comprises a groove or slot 56 extending about half way through the dimension of the gasket 18 that is parallel to the side wall 22. The groove 56 is placed over the upper ends of the side walls 22, 24, top wall 26 and bottom wall 28 and secured in place, as by the use of conventional adhesives. Because of the curved corners 32, the gasket 18 is capable of making the transition between the planar substantially perpendicular walls 22, 24, 26, 28.

The outer surface of the gasket 18 is curved and comprises a first curved section 58 which intersects an imaginary extension of the groove 56 and a pair of generally symmetrical second sections 60, 62. The first section 50 has a relatively short radius while the second sections 60, 62 have considerably longer radii. Thus, the external configuration of the gasket 18, in cross section, is similar to an inverted tear drop.

When the door 14 closes and is latched in place, the first gasket section 58 seals against the bottom surface 64 of the front door panel 36 while the second gasket section 60 seals against the inner surface 66 of the skirt 48. It will be seen that the gasket section 58 seals in a first plane 70 corresponding to the underside 64 of the front panel 36 while the gasket section 60 seals in a second plane 72 spaced from the first plane 70. Thus, the gasket 18 is compressed to substantially fill the inside surface of the short curved corner 68.

The latches 20 may be of any suitable type and are illustrated as conventional over center toggle type latches secured to the compartment side wall 22 and engaging a keeper 74 for pulling the door 14 inwardly toward the compartment 12 to compress the gasket 18 and keep it compressed. Over center toggle type latches are preferred because they are easily unlatched to open the door and thereby retrieve the fire extinguisher 46 even though the transparent window 44 may be broken if desired.

It will accordingly be seen that the cabinet 10 is air tight, as opposed to merely capable of shedding water. Thus, the fire extinguisher 46 is less likely to corrode or rust. To this end, a quantity of desiccant, such as a desiccant filled bag 76 is placed in the compartment 12 immediately before closing and sealing the door 14. The desiccant in the bag 76 accordingly adsorbs much or all of the water in the compartment 12 thereby minimizing corrosion of the fire extinguisher 46.

Referring to FIG. 5, another fire extinguisher cabinet 78 of this invention is illustrated including a compartment 80, a door or front panel 82, means (not shown) mounting the door 82 for pivotal movement between the open position to a closed position, a gasket 84 sealing between the compartment 80 and door 82 in the closed position thereof and one or more latches (not shown) securing the door 82 in its closed position.

The compartment 80 is preferably substantially identical to the compartment 12 while the door 82 provides an opaque front panel 86. The front panel 86 includes a raised peripheral section 96 providing a peripheral trough or recess 98 thereunder receiving a flat resilient gasket 100. Extending around the front panel 86 and extending generally perpendicular thereto is a skirt 102 which, in the closed position of the door 82, overlaps the upper ends of the compartment walls 104.

The gasket 84 is identical to the gasket 18 and is substantially the same length as the perimeter of the compartment 80 as measured along an edge 106. The gasket 84 comprises a groove or slot 108 extending about half way through the dimension of the gasket 84 that is parallel to the wall 104. The groove 108 is placed over the upper ends of the compartment walls 104 and secured in place, as by the use of conventional adhesives.

The outer surface of the gasket 84 is curved and comprises a first curved section 110 which intersects an imaginary extension of the groove 108 and a pair of generally symmetrical second sections 112, 114. The first section 110 has a relatively short radius while the second sections 112, 114 have considerably longer radii. Thus, the external configuration of the gasket 84, in cross section, is similar to an inverted tear drop.

When the door 82 closes and is latched in place, the first gasket section 110 seals against the flat resilient gasket 100 residing in the trough 98 of the front door panel 86 while the second gasket section 112 seals against the inner surface 116 of the skirt 102. It will be seen that the gasket section 110 seals in a first plane corresponding to the underside of the front panel 82 while the gasket section 116 seals in a second plane spaced from the first plane. Thus, the gasket 84 is compressed to substantially fill the inside surface of the short curved corner 118.

Referring to FIG. 6, another embodiment of a gasket 120 comprises an elongate bodily flexible member of substantially the same length as the perimeter of the compartment as measured along the upper edge. The gasket 120 comprises a groove or slot 122 extending about half way through the dimension of the gasket 120 that is parallel to the side wall 124. The groove 122 is placed over the upper ends of the walls 124 and secured in place, as by the use of conventional adhesives.

The outer surface of the gasket 120 is curved and comprises a pair of curved sections 126, 128 which are symmetrical about a plane defining the wall 124 and a generally cylindrical rib 130 which intersects an imaginary extension of the groove 122. The section or rib 130 has a relatively short radius while the sections 126, 128 have considerably longer radii. Thus, the external configuration of the gasket 120 is quite similar, in cross section, to the gasket 18.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. A fire extinguisher cabinet comprising a compartment having first and second side walls, top and bottom walls transverse to the side walls and a back wall, the top, bottom and side walls providing therebetween curved corners and providing edges lying in a common plane;

a front wall comprising a front panel sized to receive the edges and a peripheral skirt extending around and away from the front panel;

means sealably mounting the front wall on the compartment for preventing air entry into the compartment, including a gasket having a groove receiving the edges throughout the length thereof and an exposed curvilinear sealing surface for abutting and sealing against the front panel in a closed path comprising an extension of the edges and for abutting and sealing against the skirt throughout the periphery thereof;

means pivotably mounting the front wall on the compartment for movement between a first open position and a second closed position in which the gasket seals against the front panel and against the skirt; and means for latching the front wall in the second position; and a fire extinguisher in the compartment.

2. The fire extinguisher cabinet of claim 1 further comprising a container of desiccant material in the compartment.

3. The fire extinguisher cabinet of claim 1 wherein the gasket is of tear drop configuration having a first sealing surface facing and sealing against the front panel along a first plane and a second sealing surface facing and sealing against the skirt along a second plane spaced from the first plane.

4. The fire extinguisher cabinet of claim 1 wherein the juncture between the front panel and the skirt comprises a corner of short radius and, in the closed position of the door, the gasket substantially fills the corner.

5. A fire extinguisher cabinet comprising a compartment having first and second side walls, top and bottom walls transverse to the side walls and a back wall, the top, bottom and side walls providing therebetween curved corners and providing edges lying in a common plane;

a front wall comprising a front panel sized to receive the edges and including a peripheral groove and a peripheral skirt extending around the front panel; and means sealably mounting the front wall on the compartment for preventing air entry into the compartment, including a first gasket having a groove receiving the edges throughout the length thereof facing the peripheral groove and an exposed curvilinear sealing surfaces, and a flat resilient gasket in the peripheral groove sealing against the first gasket in a path comprising an extension of the edges and for abutting the skirt throughout the periphery thereof;

means mounting the front wall on the compartment for movement between a first open position and a second closed position in which the gasket seals against the front panel and against the skirt; and means for latching the front wall in the second position.

* * * * *